US008806753B2

(12) United States Patent
Nitta

(10) Patent No.: US 8,806,753 B2
(45) Date of Patent: Aug. 19, 2014

(54) CORRUGATING ROLL AND METHOD OF RECONDITIONING THE SAME, AND SINGLE FACER

(75) Inventor: Takashi Nitta, Mihara (JP)

(73) Assignee: Mitsubishi Heavy Industries Printing & Packaging Machinery, Ltd., Hiroshima (JP)

( * ) Notice: Subject to any disclaimer, the term of this patent is extended or adjusted under 35 U.S.C. 154(b) by 0 days.

(21) Appl. No.: 13/389,853

(22) PCT Filed: Dec. 13, 2010

(86) PCT No.: PCT/JP2010/072408

§ 371 (c)(1),
(2), (4) Date: Apr. 18, 2012

(87) PCT Pub. No.: WO2011/104978

PCT Pub. Date: Sep. 1, 2011

(65) Prior Publication Data

US 2012/0193033 A1 Aug. 2, 2012

(30) Foreign Application Priority Data

Feb. 26, 2010 (JP) ..... 2010-041701

(51) Int. Cl.

| | |
|---|---|
| ***B31F 1/00*** | (2006.01) |
| ***B31F 1/26*** | (2006.01) |
| ***B31F 1/20*** | (2006.01) |
| ***B31F 1/32*** | (2006.01) |

(52) U.S. Cl.

CPC ... *B31F 1/20* (2013.01); *B31F 1/26* (2013.01); *B31F 1/32* (2013.01)

USPC ..... 29/895.1; 29/895.3; 29/895.31

(58) Field of Classification Search

CPC ..... F16C 2220/40; F16C 2237/00; B21B 27/005; B21B 28/02; B21B 28/04; B21B 37/005; B21D 3/00; B21D 3/14; B21D 13/10

USPC ..... 29/895.1, 895.3, 895.31, 402.01, 29/402.04

See application file for complete search history.

(56) References Cited

U.S. PATENT DOCUMENTS 5,344,520 A * 9/1994 Seki et al. ..... 156/472
5,582,874 A 12/1996 Hyde (Continued)

FOREIGN PATENT DOCUMENTS

JP 62282737 A 12/1987
JP 622872737 A 12/1987

(Continued)

OTHER PUBLICATIONS

International Preliminary Report on Patentability, dated Sep. 27, 2012, issued in International Application No. PCT/JP2010/072408.

(Continued)

*Primary Examiner* — Christopher Besler
(74) *Attorney, Agent, or Firm* — Manabu Kanesaka; Benjamin J. Hauptman

(57) ABSTRACT

Reconditioning is performed such that the curvature of the arcuate surface of the crest on the upper corrugating roll is increased as compared before conditioning. Further, reconditioning is performed such that the curvature of the arcuate surface of the crest on the lower corrugating roll is increased as compared before conditioning. In this step, polishing is performed so as to maintain the maximum diameter of the crest on the upper corrugating roll as much as possible. Thereby, since the length of the inclined surface of the corrugating roll connecting between a crest and a trough of the upper and lower corrugating rolls and is reduced, the rate of the increase in the consumption of corrugated mediums of fluted corrugated mediums for double-faced corrugated cardboard sheets shaped by the upper and lower corrugating rolls and after reconditioning can be reduced.

4 Claims, 9 Drawing Sheets

(56) References Cited

U.S. PATENT DOCUMENTS

| | | | |
|---|---|---|---|
| 5,669,988 | A | 9/1997 | Takenaka et al. |
| 6,074,507 | A | 6/2000 | Sukenik |
| 7,059,051 | B2 | 6/2006 | Reich et al. |

FOREIGN PATENT DOCUMENTS

| | | | | |
|---|---|---|---|---|
| JP | 8060250 | A | | 3/1996 |
| JP | 2002500116 | A | | 1/2002 |
| JP | 3388929 | B2 | * | 3/2003 |
| JP | 2004042259 | A | | 2/2004 |
| JP | 2006062150 | A | | 3/2006 |

OTHER PUBLICATIONS

International Search Report for PCT/JP2010/072408 dated Mar. 22, 2011.

Decision to Grant a Patent mailed Jan. 7, 2014, corresponds Japanese patent application No. 2010-041701.

* cited by examiner $R_3, R_5 < R_6 < R_4$ $A_4 < A_3$

FIG. 6

FOR A FLUTE:

| No. | | Back liner bonded side corrugating roll | | Corrugated medium shaping side corrugating roll | | Corrugation repetition ratio | Increase in corrugated medium consumption (%) |
|---|---|---|---|---|---|---|---|
| | | Crest $R_{mm}$ | Trough $R_{mm}$ | Crest $R_{mm}$ | Trough $R_{mm}$ | | |
| 1 | Conventional method, new | 1.5 | 2.0 | 1.5 | 2.0 | 1.594 | 0% |
| 2 | Conventional method, reconditioned by dia. 3mm | 1.5 | 2.0 | 1.5 | 2.0 | 1.601 | 0.44% |
| 3 | Method of invention, reconditioned by dia. 3mm | 1.5 | 1.87 | 1.37 | 2.0 | 1.594 | 0% |
| 4 | Method of invention, new | 1.5 | 1.87 | 1.37 | 2.0 | 1.580 | -0.88% |

(Note) Reconditioned by dia. 3mm= 0.5 mm/cycle x 6 times

CORRUGATING ROLL AND METHOD OF RECONDITIONING THE SAME, AND SINGLE FACER

TECHNICAL FIELD

The present invention relates to a method of reconditioning a corrugating roll, which can reduce the consumption of corrugated mediums in a single facer for manufacturing single-faced corrugated cardboard sheets, a corrugating roll reconditioned with this reconditioning method, a single facer including such a corrugating roll, and a single facer that can manufacture useful double-faced corrugated cardboard sheets.

BACKGROUND ART

There are two types of single facers for manufacturing single-faced corrugated cardboard sheets by bonding a fluted corrugated medium and a back liner together: a pressure roll type and a pressure belt type. The structure of these types of single facers will be described.

FIG. 7 shows a pressure roll type single facer. In FIG. 7, this single facer 100A includes a pair of upper and lower corrugating rolls 102 and 104, a pressure roll 106 provided so as to face the lower corrugating roll 104, and a gluing unit 108.

The upper and lower corrugating rolls 102 and 104 have flute-shaped grooves in the outer periphery surfaces aligned in the axial direction, and the grooves intermesh with each other. A flat sheet corrugated medium "d" is fed from the direction of the arrow "a", and is passed through the nip between the upper and lower corrugating rolls 102 and 104, thereby being shaped into a fluted corrugated medium "e". In the gluing unit 108, glue "g" reserved in glue container 110 is skimmed by a gluing roll 112, and a doctor roll 114 screeds the film of the glue. The glue "g" sticking on the surface of the gluing roll 112 is applied on the flute tips of the fluted corrugated medium "e".

A flat sheet back liner "f" fed to the pressure roll 106 passes the nip between the pressure roll 106 and the lower corrugating roll 104, together with the fluted corrugated medium "e" on which the glue is applied, and is pressed. Thereby, the fluted corrugated medium "e" and the back liner "f" are bonded together, and a single-faced corrugated cardboard sheet "h" is manufactured.

Next, a structure of a pressure belt type single facer is briefly explained with reference to FIG. 8. In place of the pressure roll 106, this single facer 100B is provided with an endless pressure belt 116 which is pressed against the surface of an upper corrugating roll 102. A flat sheet corrugated medium "d" fed to a lower corrugating roll 104 is passed between the upper and lower corrugating rolls 102 and 104, thereby being shaped into a fluted corrugated medium "e".

Next, glue "g" is applied on the flute tips of the fluted corrugated medium "e" by a gluing roll 112. Thereafter, the flat sheet back liner "f" and the fluted corrugated medium "e" having the glue "g" applied on its flute tips are passed between the upper corrugating roll 102 and the endless pressure belt 116, to press them and bond them together. In this manner, a single-faced corrugated cardboard sheet "h" is manufactured.

Downstream of the production line, a flat sheet front liner is bonded to flute tips of the single-faced corrugated cardboard sheet thus manufactured, to which the back liner "f" is not bonded, to manufacture a double-faced corrugated cardboard sheet. It is noted that a fluted shape defined by the fluted corrugated medium "e" is referred to as a flute.

Upper and lower corrugating rolls of a single facer are manufactured from a high-strength steel, and hard chromium plating, tungsten carbide spraying, or the like, is provided on the surfaces of the corrugating rolls to provide high wear resistance. However, corrugating rolls wear as they are used. When corrugating rolls wear significantly, they are replaced at regular intervals. Then, the outer surfaces of the corrugating rolls are repolished for reusing the rolls. Since the corrugating rolls are wider than paper sheets, the corrugating rolls do not wear evenly in the width direction and the center portions of the corrugating rolls wear faster. Therefore, the corrugating rolls must be repolished such that the fluted surfaces become even in the width direction.

Patent Reference 1 discloses an improved fluted shape for a corrugating roll for preventing damages in the corrugating roll due to wear of the surface of the corrugating roll caused by friction between paper sheets and the corrugating roll.

Patent Reference 2 discloses a method of polishing corrugating rolls, which can feed paper sheets between the corrugating rolls evenly in the width direction, thereby preventing wrinkle of the paper sheets.

PRIOR ART REFERENCE

Patent Document

Patent Reference 1: Japanese Translation of PCT International Application No. 2002-500116

Patent Reference 2: Japanese Laid-open Patent Publication No. 2004-42259

DISCLOSURE OF THE INVENTION

Problems to be Solved by the Invention

FIG. 9 shows a double-faced corrugated cardboard sheet "j" manufactured by bonding a front liner "i" to a single-faced corrugated cardboard sheet manufactured with a single facer. A conventional reconditioning method of a corrugating roll polishes the outer periphery of the corrugating roll until the same corrugation height as that of a new corrugating roll is obtained evenly in the width direction, without changing the curvatures of the arcuate surfaces of crests and troughs. In the conventional reconditioning method, the diameter of the flute tips reduces after reconditioning. As a result, the length of the periphery of the corrugating roll is reduced. However, since the number of the corrugations on the corrugating roll remains constant, the pitch of the corrugations per unit length is reduced relatively with respect to the front and back liners "f" and "i".

In other words, as shown in FIG. 9, the corrugation pitch $P_2$ of a fluted corrugated medium "e" after reconditioning is reduced with respect to the corrugation pitch $P_1$ of a fluted corrugated medium "e" before the reconditioning. This leads to an increase in the consumption of a corrugated medium "d", i.e., the corrugation repetition ratio (the length of the corrugated medium/the length of the front and back liners).

The Table in FIG. 10 shows the relationship between the reconditioning count and the corrugation repetition ratio. As the reconditioning count increases, the corrugation repetition ratio and the consumption of corrugated mediums increase. About six times of reconditioning would be possible, in view of the thickness of the hardening layers of the corrugating rolls. However, due to an increase in the consumption of corrugated mediums, a typical reconditioning count is limited to about three and corrugating rolls are discarded after they experience three times of reconditioning.

Next, examples of the rate of increase in the consumption of corrugated mediums and the resultant increases in the cost will be presented. Given that the A flute is used, the production per day is 100 thousands meters, the average paper width is 1.7 meters, and the basis weight of corrugated mediums is 125 g/m$^2$.

When new corrugating rolls are used, the annual consumption of corrugated mediums amounts to 0.125 kg/m$^2$×1.7 meters×100 thousands meters/day×1.594 (corrugation repetition ratio)×20 days/month×12 months/year=8129.4 tons.

Given that the cost of the corrugated mediums is 56 yens/kg, the cost for the corrugated mediums amounts to 455,246 thousands yens.

The annual consumption of corrugated mediums after three times of reconditioning is calculated as follows:

0.125 kg/m$^2$×1.7 meters×100 thousands meters/day×1.597 (corrugation repetition ratio)×20 days/month×12 months/year=8144.7 tons.

Given that the cost of the corrugated mediums is 56 yens/kg, the cost for the corrugated mediums amounts to 456,103 thousands yens, which represents a cost increase of 857 thousands yens.

The consumption of corrugated mediums after six times of reconditioning is:

0.125 kg/m$^2$×1.7 meters×100 thousands meters/day×1.6014 (corrugation repetition ratio)×20 days/month×12 months/year=8165.1 tons.

Given that the cost of the corrugated mediums is 56 yens/kg, the cost for the corrugated mediums amounts to 457,246 thousands yens, which represents a cost increase of 2,000 thousands yens. As calculated above, the increase in the cost of corrugated mediums caused by reconditioning is ineligible.

In view of the issues of the conventional techniques, a first object of the present invention is to reduce the consumption of corrugated mediums during manufacturing of corrugated cardboard sheets, when corrugating rolls are reconditioned after use, thereby reducing an increase in the cost of paper sheets.

A second object of the present invention is to provide a single facer which can manufacture a double-faced corrugated cardboard sheet exhibiting performances useful for economical packaging boxes.

SUMMARY OF THE INVENTION

In order to achieve the above-identified objects, the method of reconditioning a corrugating roll of the present invention is a method of reconditioning a corrugating roll, the corrugating roll having an fluted outer periphery surface and is mounted in a single facer for manufacturing a single-faced corrugated cardboard sheet made from an fluted corrugated medium and a back liner after being used for manufacturing the single-faced corrugated cardboard sheet, the method including: conditioning the corrugating roll such that a curvature of an arcuate surface of an crest on the corrugating roll including a flute tip is increased as compared to the curvature before the conditioning, while minimizing polishing of the flute tip of the crest to maintain a maximum diameter of the corrugating roll.

In the method of the present invention, when the corrugating roll is reconditioned, by increasing a curvature of a curved surface of a crest on the corrugating roll as compared to the curvature before the conditioning, while minimizing polishing of the flute tip of the crest to maintain a maximum diameter of the corrugating roll, the length of the inclined surface of the corrugating roll connecting the flute tip of the crest and the bottom of the trough of the corrugating roll can be reduced. Thereby, an increase in the consumption of corrugated mediums can be suppressed.

In the method of the present invention, if the corrugating roll has the crest having a curved surface defined by a plurality of different curvatures, the conditioning may be performed such that a cross-sectional area of a cross section surrounded by a straight line connecting intersections of the curved surface and an inclined surface and the curved surface becomes smaller than a cross-sectional area of that cross section before the conditioning. In the corrugating roll of the above-described structure, by conditioning in such a manner, a curvature of a curved surface of a crest can be increased compared to that before the conditioning, and the length of the inclined surface of the corrugating roll connecting the flute tip of the crest and the bottom of the trough can be reduced. As a result, an increase in the consumption of corrugated mediums can be reduced.

Further, in the method of the present invention, if the corrugating roll has the crest in a bone flute shape, the conditioning may be performed such that a cross-sectional area of a cross section surrounded by a straight line connecting a starting point and an end point at which the crest contacts the corrugated medium and the curved surface of the crest becomes smaller than a cross-sectional area of that cross section before the conditioning. In the corrugating roll of the above-described structure, by conditioning in such a manner, a curvature of a curved surface of a crest can be increased as compared to that before conditioning, and accordingly, an increase in the consumption of corrugated mediums can be suppressed.

The method of the present invention may include conditioning such that polishing of a bottom of a trough of a corrugating roll to be intermeshed with each other is minimized in order to increase a curvature of a curved surface including the bottom, in accordance with an increase in the curvature of the curved surface of the crest upon the reconditioning, and conditioning such that a difference between a curvature of a curved surface of a crest on a corrugated medium feed direction downstream side corrugating roll and a curvature of a curved surface of a trough on a corrugated medium feed direction upstream side corrugating roll, intermeshing with the downstream side corrugating roll to shape a fluted corrugated medium, is substantially the same as a difference between a curvature of a curved surface of a crest on the corrugated medium feed direction upstream side corrugating roll and a curvature of a curved surface of a trough on the corrugated medium feed direction downstream side corrugating roll.

As described above, upon reconditioning, not only the crest but also the trough facing that crest are conditioned such that a curvature of a curved surface of the trough facing the crest is increased, and reconditioning is performed such that the differences of a curvature of a curved surface of the trough and the crest of a pair of corrugating rolls facing with each other are substantially the same, before and after the reconditioning. Thus, the compression mold performance of the corrugated medium by the corrugating roll after reconditioning can be preserved satisfactorily, as well as suppressing an increase in consumption in the corrugated mediums.

As used herein, "curved surfaces" of the crests or the troughs are arcuate surfaces, for example, and may have a curved surface in any shapes other than an arcuate surface, such as two or more curved surface defining a part of a circle or an ellipse.

Furthermore, the corrugating roll of the present invention is a corrugating roll reconditioned using the above-described reconditioning method. By using corrugating roll having such a configuration, an increase in the consumption of corrugated mediums can be suppressed.

Further, a single facer of the first present invention includes: fluted outer periphery surfaces intermeshing with each other; a pair of corrugating rolls for shaping a fluted corrugated medium; a gluing unit that applies glue to a flute tip of the fluted corrugated medium; and a pressure unit that presses the glued fluted corrugated medium and a back liner to bond them together, in conjunction with one of the corrugating rolls, wherein at least one of the corrugating rolls includes the corrugating roll according to claim 3 or 4.

Since the single facer of the first invention includes a corrugating roll reconditioned using the above-described reconditioning method, an increase in the consumption of corrugated mediums can be suppressed.

In the single facer of the first present invention, if the pressure unit is a pressure roll that presses the fluted corrugated medium and the back liner to bond them together, in conjunction with a corrugated medium feed direction downstream side corrugating roll, the corrugating roll having the crest reconditioned with the reconditioning method of the present invention may be used only as a corrugated medium feed direction upstream side corrugating roll that shapes the fluted corrugated medium, in conjunction with the corrugated medium feed direction downstream side corrugating roll. If the pressure unit provided in the single facer is a pressure roll, a significant local surface pressure is applied to a nip between the corrugating rolls, as compared to a pressure belt. Accordingly, from the view point of preventing a paper sheet from being cut, the corrugating roll of the present invention having an increased curvature of the arcuate surface of the crest is preferably applied to the corrugated medium feed direction upstream side corrugating roll for shaping a fluted corrugated medium.

In the single facer of the first present invention, if the pressure unit is a pressure belt that presses the corrugated medium and the back liner to bond them together, in conjunction with a corrugated medium feed direction downstream side corrugating roll, the corrugating roll having the crest reconditioned with the reconditioning method of the present invention may be used as at least one of the downstream side corrugating rolls in the corrugated medium feed direction, and a corrugated medium feed direction upstream side corrugating roll that shapes the fluted corrugated medium, in conjunction with the downstream side corrugating roll.

If the pressure unit provided in the single facer is a pressure belt, not a significant local surface pressure is applied to a nip between the corrugating rolls, as compared to a pressure roll. Accordingly, the corrugating roll of the present invention having an increased curvature of the arcuate surface of the crest may be applied to any of a pair of corrugating rolls without any problem.

Further, a single facer of the second present invention includes: fluted outer periphery surfaces intermeshing with each other; a pair of corrugating rolls for shaping a fluted corrugated medium; a gluing unit that applies glue to a flute tip of the fluted corrugated medium; and a pressure unit that presses the glued fluted corrugated medium and a back liner to bond them together, in conjunction with one of the corrugating rolls, wherein a curvature of a curved surface of a crest on a corrugated medium feed direction upstream side corrugating roll is configured to become greater than a curvature of a curved surface of a crest on the corrugated medium feed direction downstream side corrugating roll that bonds a corrugated medium and a back liner together, intermeshing with the downstream side corrugating roll to shape a fluted corrugated medium, and wherein the single facer is capable of manufacturing a double-faced corrugated cardboard sheet wherein a curvature of a curved surface of the fluted corrugated medium shaped in a joint portion with the front liner is greater than a curvature of a curved surface of the fluted corrugated medium shaped in a joint portion with the back liner.

Since a curvature of a curved surface of the fluted corrugated medium shaped in a joint portion with the front liner is made greater than a curvature of a curved surface of a fluted corrugated medium shaped in a joint portion with the back liner in the single facer of the second invention, the consumption of corrugated mediums can be suppressed and accordingly the cost of corrugated cardboard sheets can be reduced, as in the single facer of the first invention.

Further, a curvature of a curved surface of a crest on the corrugated medium feed direction downstream side corrugating roll that bonds a corrugated medium and a back liner together is made smaller than a curvature of a curved surface of a crest on the corrugated medium feed direction upstream side corrugating roll, intermeshing with that downstream side corrugating roll to shape a fluted corrugated medium. Thus, not a significant local surface pressure is applied to paper sheets, when pressure bonding the fluted corrugated medium and the back liner together. Accordingly, even when paper sheets are applied to a pressure roll type single facer, the paper sheets are prevented from being cut.

Further, a double-faced corrugated cardboard sheet can be manufactured, wherein a curvature of a curved surface of the fluted corrugated medium shaped in a joint portion with the front liner is greater than a curvature of a curved surface of the fluted corrugated medium shaped in a joint portion with the back liner. When a corrugated cardboard box is manufactured from that double-faced corrugated cardboard sheet, the curvature of the bonded portion of the fluted corrugated medium bonded to the back liner defining the interior surface of the corrugated cardboard box is made smaller and the curvature of the bonded portion of the fluted corrugated medium bonded to the front liner defining the exterior surface of the corrugated cardboard box is made greater.

Accordingly, the cushioning characteristic of the back liner is ensured. At the same time, on the front liner side, the amount of glue applied to the bonded portion of the front liner and the fluted corrugated medium can be reduced, and accordingly, the cost reduction can be achieved, while keeping protection to an article to be packaged. Further, since the glue applied to the bonded portion of the front liner and the fluted corrugated medium can be reduced, the shrinkage after the solidification of the glue can be reduced, which ensures the flatness of the front liner and a proper printability.

In the single facer of the second present invention, a difference between a curvature of an arcuate surface of a crest on the corrugated medium feed direction downstream side corrugating roll, used for bonding of the corrugated medium and the back liner, and a curvature of a curved surface of a trough on the corrugated medium feed direction upstream side corrugating roll, intermeshing with that downstream side corrugating roll to shape a fluted corrugated medium may be substantially the same as a difference between a curvature of a curved surface of a crest on the corrugated medium feed direction upstream side corrugating roll and a curvature of a curved surface of a trough on the corrugated medium feed direction downstream side corrugating roll. As a result, the compression mold performance of the fluted corrugated medium of the bonded portion with the back liner, and the bonded portion with the front liner can be preserved favorably. Accordingly, the performance of the double-faced corrugated cardboard sheet can be further improved.

Effect of the Invention

In accordance with the method of the present invention, since a method of reconditioning a corrugating roll, the corrugating roll having an fluted outer periphery surface and is mounted in a single facer for manufacturing a single-faced corrugated cardboard sheet made from an fluted corrugated medium and a back liner after being used for manufacturing the single-faced corrugated cardboard sheet, the method including: conditioning the corrugating roll such that a curvature of an arcuate surface of an crest on the corrugating roll including a flute tip is increased as compared to the curvature before the conditioning, while minimizing polishing of the flute tip of the crest to maintain a maximum diameter of the corrugating roll. Accordingly, as compared to conventional techniques, an increase in the consumption of corrugated mediums during manufacturing of corrugated cardboard sheets can be suppressed, and an increase in the cost of paper sheets can be reduced.

Further, the corrugating roll of the present invention reconditioned using the method of the present invention, and the single facer of the first invention including the corrugating roll of the present invention also provide the similar effects as those of the method of present invention.

Further, a single facer of the second present invention includes: fluted outer periphery surfaces intermeshing with each other; a pair of corrugating rolls for shaping a fluted corrugated medium; a gluing unit that applies glue to a flute tip of the fluted corrugated medium; and a pressure unit that presses the glued fluted corrugated medium and a back liner to bond them together, in conjunction with one of the corrugating rolls, wherein a curvature of a curved surface of a crest on a corrugated medium feed direction upstream side corrugating roll is configured to become greater than a curvature of a curved surface of a crest on a corrugated medium feed direction downstream side corrugating roll that bonds a corrugated medium and a back liner together, intermeshing with the downstream side corrugating roll to shape a fluted corrugated medium, and wherein the single facer is capable of manufacturing a double-faced corrugated cardboard sheet wherein a curvature of a curved surface of the fluted corrugated medium shaped in a joint portion with the front liner is greater than a curvature of a curved surface of the fluted corrugated medium shaped in a joint portion with the back liner. Accordingly, on back liner side to define the interior surface of a corrugated cardboard box, a cushioning characteristic is ensured, keeping protection to an article to be packaged. At the same time, on the front liner side, the amount of glue applied to the bonded portion of the front liner and the fluted corrugated medium can be reduced, and accordingly, the cost reduction can be achieved, while ensuring the flatness of the front liner and a proper printability.

Further, a curvature of a curved surface of a crest on the corrugated medium feed direction downstream side corrugating roll, which presses the fluted corrugated medium and the back liner, is made smaller than the curvature of the arcuate surface of the crest on the corrugated medium feed direction upstream side corrugating roll, which intermeshes with the downstream side corrugating roll to shape the fluted corrugated medium. Accordingly, since a significant local surface pressure is not applied to the paper sheets upon pressure bonding between the fluted corrugated medium and the back liner, the paper sheets are prevented from being cut even when they are applied to a pressure roll type single facer.

BRIEF DESCRIPTION OF THE DRAWINGS

FIG. 6 is a table showing the rates of increases in the consumption of corrugated mediums for a double-faced corrugated cardboard sheet in the technique of the present invention and a conventional technique;

FIG. 10 is a diagram illustrating double-faced corrugated cardboard sheets manufactured using new corrugating rolls and corrugating rolls reconditioned with a conventional reconditioning method.

DESCRIPTION OF EMBODIMENTS

Figure 1:
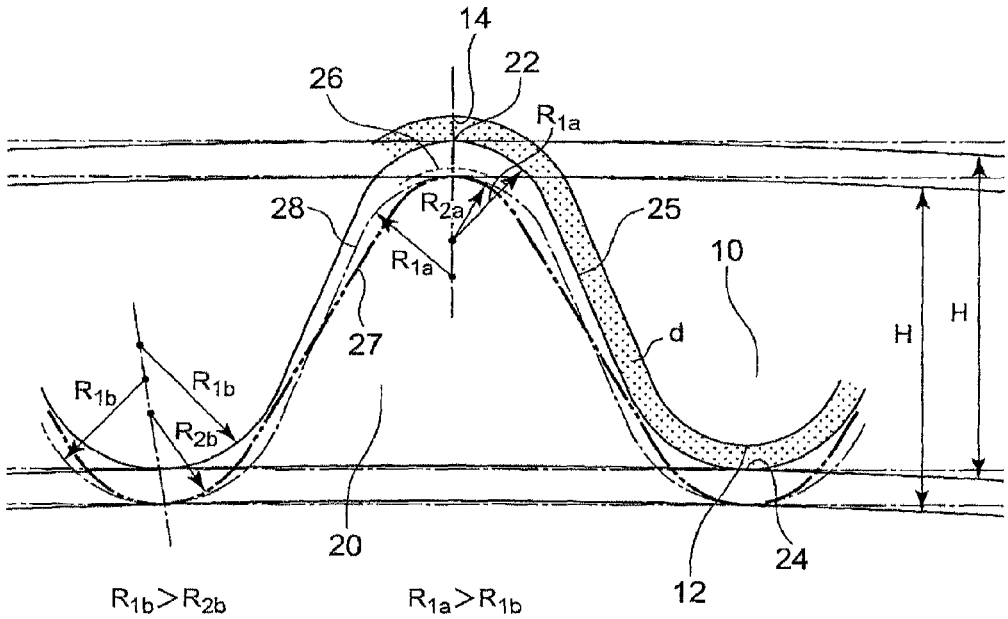
FIG. 1 is a cross-sectional view of a first embodiment of a corrugating roll reconditioned by a method of the present invention.

Hereinafter, the present invention will be described with reference to embodiments of the present invention shown in the drawings. Unless otherwise stated, it is not intended that the sizes, materials, shapes, relative positions, and the like of components described in the embodiments do not limit the scope of the present invention to these specifics.

First Embodiment

A first embodiment of a method and an apparatus of the present invention will be described with reference to FIG. 1. FIG. 1 shows an intermeshing between an upper corrugating roll 10 and a lower corrugating roll 20 mounted in a single facer, wherein a corrugated medium "d" is passed through the intermeshing. This embodiment shows an example wherein arcuate surfaces of crests 12 on the upper corrugating roll 10 and crests 22 on the lower corrugating roll 20 have the same curvature radius $R_{1a}$, and wherein arcuate surfaces of troughs 14 on the upper corrugating roll 10 and troughs 24 on the lower corrugating roll 20 have the same curvature radius $R_{1b}$ (which is different from the curvature radius $R_{1a}$, i.e., $R_{1a}<R_{1b}$).

After this single facer is used for about one year, the portions of the upper and lower corrugating rolls 10 and 20 contacting paper sheets wear and the outer periphery surfaces become uneven in the roll width direction. In such a case, the corrugating rolls require reconditioning. In the drawing, the solid line 25 indicates the outer periphery surface of the lower corrugating roll 20 when it is new, and the broken line 26 indicates the outer periphery surface of the lower corrugating roll 20 after the crests 22 on the lower corrugating roll 20 wear. The chain double-dashed line 27 indicates the reconditioning line for the lower corrugating roll 20. The lower corrugating roll 20 is to be polished along the reconditioning line 27. The dot-and-dash line 28 indicates a reconditioning line for a conventional reconditioning method. It is noted that the reconditioning line for the upper corrugating roll 10 is omitted in FIG. 1.

For the lower corrugating roll 20, the curvature radius $R_{1a}$ of the arcuate surface of the crests 22 before the reconditioning and the curvature radius $R_{2a}$ of the arcuate surface of the crests 22 after the reconditioning, and the curvature radius $R_{1b}$ of the arcuate surface of the troughs 24 before the reconditioning and the curvature radius $R_{2b}$ of the arcuate surface of the troughs 24 after the reconditioning satisfy the relationship: $R_{2a}<R_{1a}$, $R_{2b}<R_{1b}$, $(R_{1a}-R_{2a})\approx(R_{1b}-R_{2b})$. In other words, the arcuate surfaces of the crests 22 and the troughs 24 on the lower corrugating roll 20 on the reconditioning line are polished such that the curvatures thereof are increased than the curvatures before the reconditioning. Further, the arcuate surfaces of the crests 22 and the troughs 24 on the lower corrugating roll 20 are polished such that the difference of the curvatures of the crests 22 before and after the reconditioning equals the difference of the curvatures of the troughs 24 before and after the reconditioning. This is done to maintain a better compression mold performance of a corrugated medium "d" by keeping the compression space of the corrugated medium "d" after reconditioning substantially the same as the compression space before the reconditioning.

On the other hand, in the conventional reconditioning method shown by the reconditioning line 28, the curvature radius of the arcuate surface of the crests 22 is $R_{1a}$ and the curvature of the arcuate surface of the troughs 24 is $R_{1b}$, both before and after the reconditioning. The height H of the corrugations on the upper and lower corrugating rolls 10 and 20 is the same before and after the reconditioning both in this embodiment and in the conventional method. It is noted that although not shown in this embodiment, the reconditioning line for the upper corrugating roll 10 is determined in the similar manner as the reconditioning line for the lower corrugating roll 20.

The polishing of the flute tips of the crests 12 and 22 defining the maximum diameters of the upper and lower corrugating rolls 10 and 20 is minimized so as not to reduce the maximum diameters of the upper and lower corrugating rolls 10 and 20. That is, the polishing of the flute tips of the crests 12 and 22 is limited to the minimum required to form a smooth curve with the arcuate surfaces on the both sides.

In accordance with this embodiment, by increasing the curvatures of the arcuate surfaces of the crests in the crests 12 and 22 and the troughs 22 and 24 on the upper and lower corrugating rolls 10 and 20, while minimizing the reduction in the maximum diameters of the upper and lower corrugating rolls 10 and 20, the length of the inclined surface of the corrugating roll connecting between a crest and a trough is reduced for the upper and lower corrugating rolls. Thereby, an increase in the consumption of corrugated mediums "d" can be reduced, and accordingly, an increase in the cost of paper sheets can be reduced.

It is noted that, in this embodiment, the consumption of corrugated mediums can also be reduced by reconditioning only the crests 12 and 22 on the upper and lower corrugating rolls 10 and 20 along the reconditioning line. Without reconditioning the troughs 14 and 24 on the upper and lower corrugating rolls 10 and 20, even the previous curvature radius $R_{1b}$ is kept, corrugated mediums "d" can be shaped without any problem as long as the difference of the curved surface profiles of the crests and the troughs is within an allowable range. Alternatively, only the crests on one of the upper and lower corrugating rolls 10 and 20 may be conditioned along the reconditioning line. Also in this case, an increase in the consumption of corrugated mediums "d" can be reduced.

Figure 7:
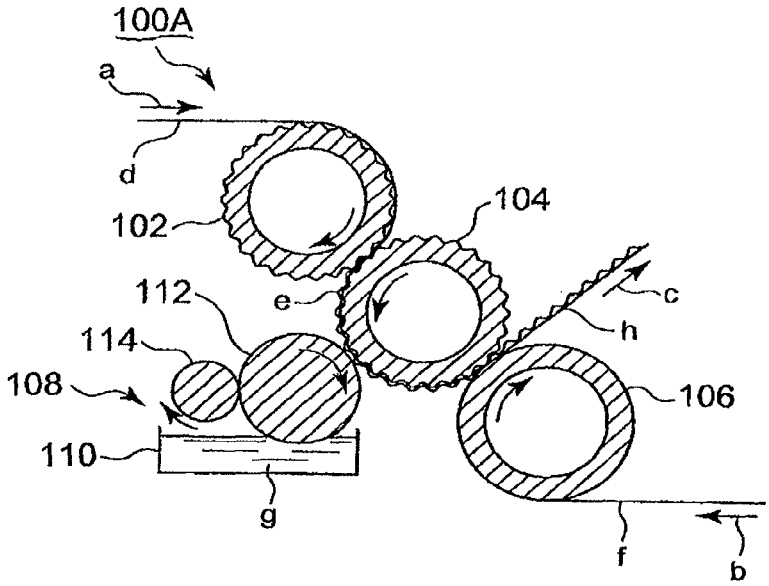
PRIOR ART FIG. 7
FIG. 7 is a cross-sectional view of a pressure roll type single facer.

However, for corrugating rolls mounted in a pressure roll type single facer shown in FIG. 7, when the reconditioning method of the present invention to increase the curvature of the arcuate surface of the crests is preferably carried out only to an upper corrugating roll 102 for shaping a fluted corrugated medium "e". This is because, if this method is applied to a lower corrugating roll 104 for bonding a fluted corrugated medium "e" and a back liner "f" together, in conjunction with the pressure roll 106, the curvature of the crests on the lower corrugating roll 104 is increased. As a result, the local surface pressure becomes too high at the nip between the lower corrugating roll 104 and the pressure roll 106, which may cause the single-faced corrugated cardboard sheet "h" to be cut in the nip.

Figure 8:
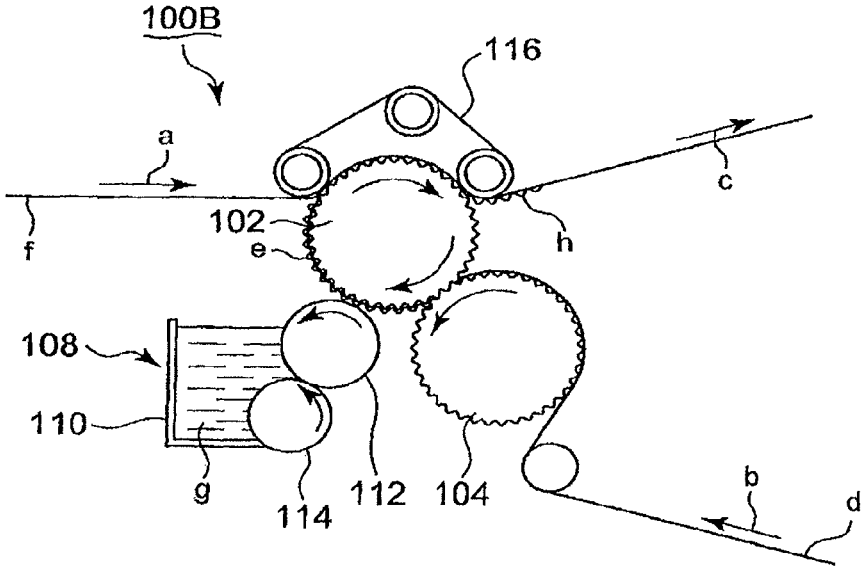
FIG. 8 PRIOR ART
FIG. 8 is a cross-sectional view of a pressure belt type single facer.
Figure 9:
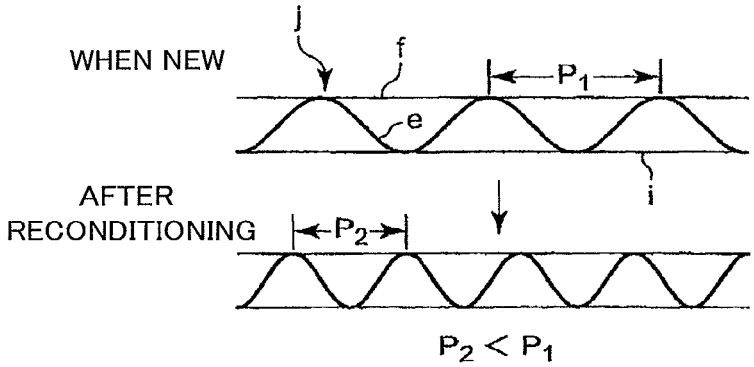
FIG. 9 PRIOR ART
FIG. 9 is a table showing the rate of the increase in the consumption of corrugated mediums for double-faced corrugated cardboard sheets manufactured using corrugating rolls reconditioned with a conventional reconditioning method.

In contrast, in the pressure belt type single facer shown in FIG. 8, not a significant local surface pressure is generated in the nip between the upper corrugating roll 102 and the pressure belt 116. Thus, the reconditioning method of the present invention may be applied to both or one of the upper corrugating roll 102 and the lower corrugating roll 104.

Second Embodiment

Next, a second embodiment of a method and an apparatus of the present invention will be described with reference to FIG. 2. This embodiment is an example wherein the curved surface 32 of the crests on the upper or lower corrugating roll is defined by a curved surface of two different curvatures.

Figure 2A:
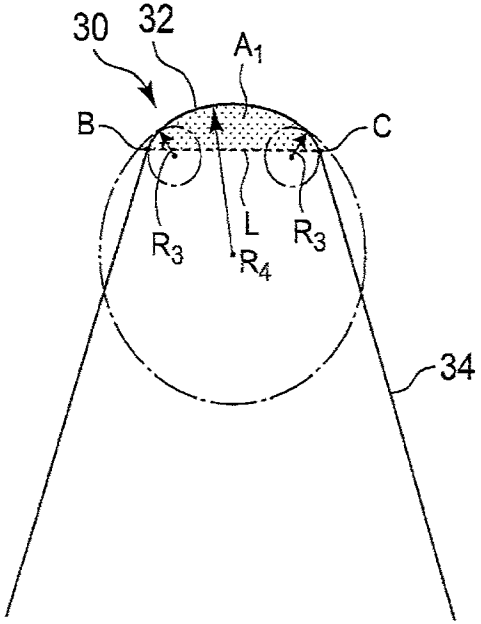
FIG. 2 is a cross-sectional view of a second embodiment of a corrugating roll reconditioned by a method of the present invention, wherein (A) shows the corrugating roll before the reconditioning and (B) shows the corrugating roll after the reconditioning.
Figure 2B:
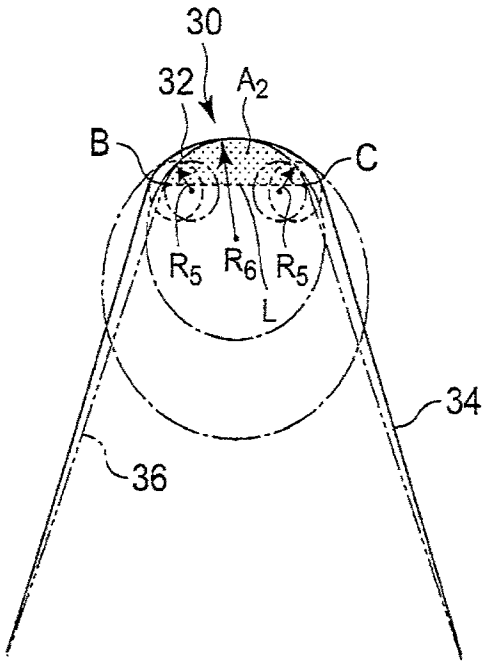

As shown in FIG. 2, when the curved surface 32 of the crest on the corrugating roll is defined from a curved surface having two different curvature radii $R_3$ and $R_4$, the area of the region surrounded by the straight line L connecting the starting point B and the end point C of the curved surface 32 intersecting the inclined surface 34 and the curved surface 32 is $A_1$. Further, the area of the same region after reconditioning is $A_2$. The curvature radii $R_5$ and $R_6$ after reconditioning and the reconditioning line 36 are determined such that the area $A_2$ becomes smaller than the area $A_1$, and reconditioning is carried out. In this case, in FIG. 2, the relationship $R_3$ and $R_5<R_6<R_4$ is presented as one example. However, as long as $A_2<A_1$ is satisfied, the curvature radii is not limited to the ones satisfying the above relationship and may be smaller or greater. It is noted that, the curved surface 32 may have a curved surface of any shapes other than a curved surface having two different curvature radii, and may be of two or more curved surfaces defining a part of a circle or an ellipse, for example.

The polishing of the flute tips defining the maximum diameter of the corrugating roll is limited to the minimum required to form a smooth curve with the curved surfaces on the both sides. By reconditioning along the reconditioning line 36, an increase in the consumption of corrugated mediums "d" can be reduced, and accordingly, an increase in the cost of paper sheets can be reduced.

Third Embodiment

Next, a third embodiment of a method and an apparatus of the present invention will be described with reference to FIG.

Figure 3:
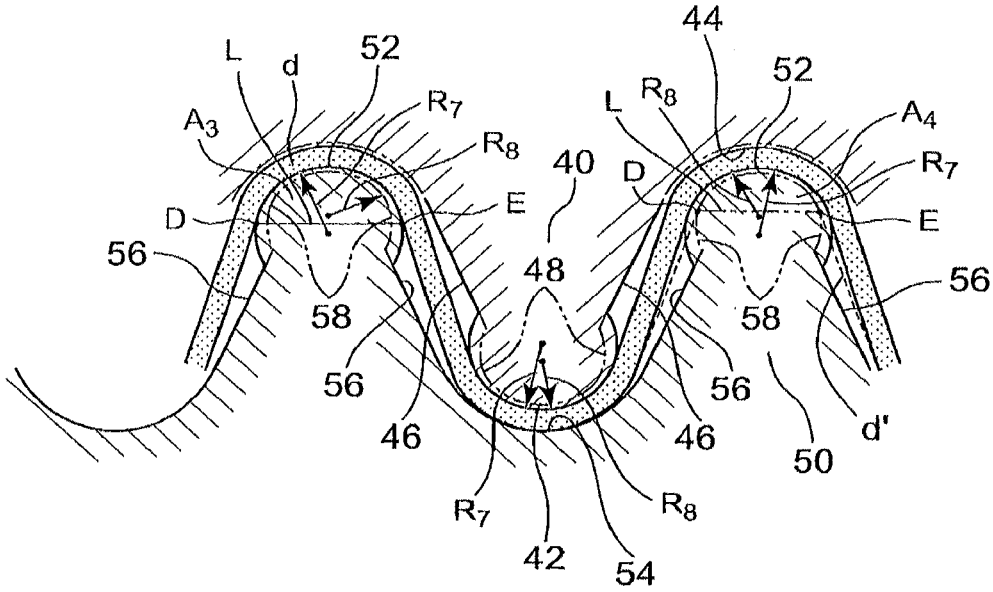
FIG. 3 is a cross-sectional view of a third embodiment of a corrugating roll reconditioned by a method of the present invention.

3. This embodiment is an example wherein crests 42 and 52 on upper and lower corrugating rolls 40 and 50 have so-called bone flute shapes. As shown in FIG. 3, in the bone flute shapes, the inclined surfaces 46 and 56 connecting between the crests and the troughs 44 and 54 are displaced backward with respect to a corrugated medium "d", with respect to the crests 42 and 52 on the upper and lower corrugating rolls 40 and 50. Thus, since the surface pressure applied to the corrugated medium "d" is reduced in the regions of the inclined surface 46 and 56, the corrugated medium "d" is less susceptible to cut, even when the conveyer speed of the corrugated medium "d" is increased.

The curvature radius of the arcuate surface of the crests 42 and 52 before reconditioning is $R_7$. In this embodiment, the reconditioning line for the upper corrugating roll 40 is indicated by the chain double-dashed line 48, and the reconditioning line for the lower corrugating roll 50 is indicated by the chain double-dashed line 58. The curvature radius $R_8$ of the reconditioning lines 48 and 58 is smaller than the curvature radius $R_7$ before reconditioning. In FIG. 3, only the reconditioning line 58 for the lower corrugating roll 50 is shown when the upper and lower corrugating rolls 40 and 50 are intermeshed with each other, interposing the corrugated medium "d" between the corrugating rolls 40 and 50. The reconditioning line 58 will be described as an example.

Given that the area of the region surrounded by the straight line L connecting the starting point D and the end point E at which the crest 52 contacts the corrugated medium "d" and the arcuate surface of the crest 52 before reconditioning $A_3$, the area of the same region after the reconditioning is $A_4$. The curvature of the arcuate surface of the crest 52 may be determined such that the area of the region after reconditioning $A_4$ becomes smaller than the area of the region before reconditioning $A_3$. The surface of the corrugated medium "d" after reconditioning is indicated by the line (broken line) d'. The reconditioning line 48 for the upper corrugating roll 40 can be determined using a similar procedure.

Also in this example, the polishing of the flute tips defining the maximum diameter of the corrugating rolls 40 and 50 is limited to the minimum required to form a smooth curve with the curved surfaces on the both sides.

In accordance with this embodiment, by repolishing the bone flute shape crests 42 and 52 on the upper and lower corrugating rolls 40 and 50 along the reconditioning lines 48 and 58, the length of the corrugated medium "d" interposed between the crests 42 and 52 on the upper and lower corrugating rolls 40 and 50 can be reduced. Thereby, an increase in the consumption of corrugated mediums "d" can be reduced, and accordingly, an increase in the cost of paper sheets can be reduced.

It is noted that in this embodiment, an increase in the consumption of corrugated mediums "d" can also be reduced by reconditioning only one of the upper and lower corrugating rolls 40 and 50 along the reconditioning line 48 or 58.

Fourth Embodiment

Figure 4:
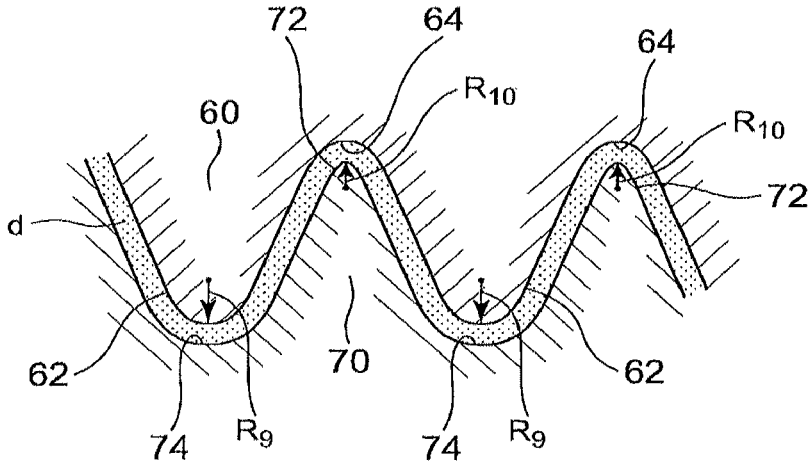
FIG. 4 is a cross-sectional view showing an embodiment of a corrugating roll mounted in a single facer of the present second invention.

Next, one embodiment of a single facer of a second invention will be described with reference to FIGS. 4 and 5. In FIG. 4, upper and lower corrugating rolls 60 and 70 are mounted in a single facer. The curvature radius $R_{10}$ of the arcuate surface of crests 72 on the lower corrugating roll 70 is smaller than the curvature radius $R_9$ of the arcuate surface of crests 62 on the upper corrugating roll 60.

Note that the upper and lower corrugating rolls may be located upside down, depending on how the rolls are positioned in the single facer.

Figure 5:
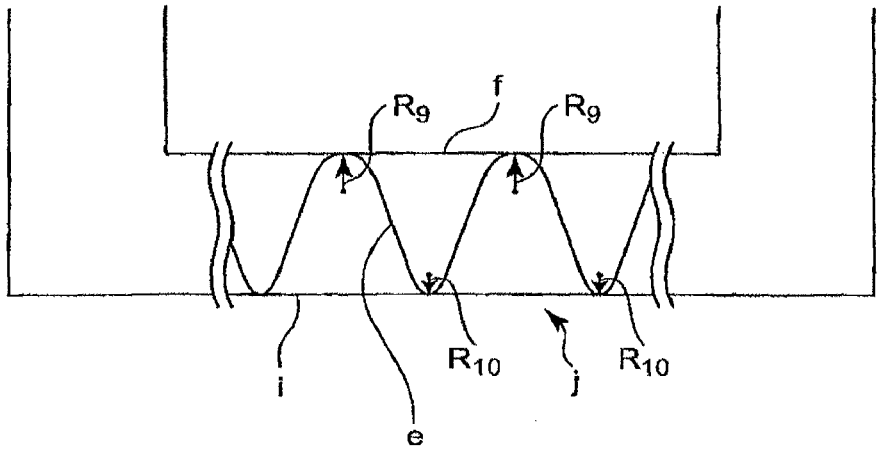
FIG. 5 is a cross-sectional view of a corrugated cardboard box manufactured by a single facer including a corrugating roll in FIG. 4.

As shown in FIG. 5, in a double-faced corrugated cardboard sheet "j" manufactured in a single facer including upper and lower corrugating rolls structured as described above, the curvature radius $R_{10}$ of the arcuate surface of the bonded portion of the fluted corrugated medium "e" bonded to the front liner "i" is smaller than the curvature radius $R_9$ of the arcuate surface of the bonded portion of the fluted corrugated medium "e" bonded to the back liner "f".

As described above, since the curvature radius $R_{10}$ of the arcuate surface of the crests 72 on the lower corrugating roll 70 is set to be smaller, the length of the inclined surface of the corrugating roll connecting the flute tip of the crest and the bottom of the trough on the lower corrugating roll 70 can be reduced. Thereby, since an increase in the consumption of corrugated mediums can be reduced, an increase in the cost of paper sheets can be reduced.

Further, since the curvature radius $R_9$ of the arcuate surface of the bonded portion of the fluted corrugated medium "e" bonded to the back liner "f" is not made smaller, the cushioning characteristic of the back liner "f" is ensured and protection to an article to be packaged is maintained. On the front liner side, the amount of glue applied to the bonded portion with a fluted corrugated medium can be reduced, and accordingly, the cost reduction can be achieved. Further, since the glue can be reduced, the shrinkage after the solidification of the glue can be suppressed, which ensures the flatness of the front liner and a proper printability.

It is noted that in this embodiment, since the curvature radius $R_9$ of the crests 62 on the upper corrugating roll 60 used to press the back liner "f" and the fluted corrugated medium "e" to bond them together is increased, the local surface pressure upon pressing is small. Accordingly, this method can be applied both pressure roll type and pressure belt type single facers.

EXAMPLES

Second Invention

Results of calculations for single-faced corrugated cardboard sheets manufacture with single facers reconditioned with the method of the present invention or a conventional method, and a single facer of the second invention are indicated in FIG. 6. The surfaces of corrugating rolls indicated in No. 1 are polished by 0.5 mm in diameter using the conventional method (No. 2) and the method of the present invention (No. 3), and the polishing is repeated six times for each roll. The results in No. 4 indicate the calculation for a single facer of the second invention.

With the conventional method (No. 2), the curvature radii before and after reconditioning are identical for the crests and the troughs. In contrast, with the method of the present invention (No. 3), the curvature radius of the crests on the corrugated medium shaping side corrugating roll is reduced by Δ0.13 mm (from 1.5 mm to 1.37 mm), and the curvature radius of the troughs on the back liner bonding side corrugating roll, which faces the crests interposing the corrugated medium "d" therebetween, is also reduced by Δ0.13 mm (from 2.0 mm to 1.87 mm). As a result, the compression mold performance of the corrugated medium "d" can be maintained satisfactorily.

Comparison of the results of No. 2 with those of No. 1 reveals that the consumption of corrugated mediums is increased by 0.44% in the conventional method after reconditioning. However, comparison of the results of No. 3 with those of No. 1 reveals that the present invention does not experience any increase in the consumption of corrugated mediums. In other words, the present invention can suppress an increase in the consumption of corrugated mediums.

When new, the single facer of the second invention (No. 4) has a curvature radius of the crests on the back liner bonding side corrugating roll of 1.5 mm, which is greater than a curvature radius of the crests on the corrugated medium shaping side corrugating roll of 1.37 mm. As apparent from comparison of the results of No. 4 with those of No. 1 in FIG. 6, even when the corrugating rolls are new, the consumption of corrugated mediums can be reduced by 0.88% in the reconditioning method of the present invention and the single facer of the second invention. Further, an increase rate in the consumption of corrugated mediums can be further suppressed after reconditioning, as compared to the conventional reconditioning method.

INDUSTRIAL APPLICABILITY

In accordance with the present invention, in manufacturing of corrugated cardboard sheets, an increase in the consumption of corrugated mediums can be suppressed, and an increase in the cost of paper sheets can be reduced, as well as achieving corrugated cardboard boxes exhibiting an improved packaging performance.

The invention claimed is:

1. A method of reconditioning at least one of a first corrugating roll and a second corrugating roll being intermeshed with each other to manufacture a fluted corrugated medium, the first and the second corrugating rolls each having a fluted outer periphery surface and being mounted in a single facer for manufacturing a single-faced corrugated cardboard sheet made from the fluted corrugated medium and a back liner after being used for manufacturing the single-faced corrugated cardboard sheet, the method comprising:

conditioning the at least one corrugating roll such that a curvature of an arcuate surface of a crest on the at least one corrugating roll including a flute tip is increased as compared to the curvature before the conditioning, while minimizing polishing of the flute tip of the crest to maintain a maximum diameter of the at least one corrugating roll.

2. The method of reconditioning a corrugating roll according to claim 1, wherein the corrugating roll has the crest having a curved surface defined by a plurality of different curvatures, and the conditioning is performed such that a cross-sectional area of a cross section surrounded by a straight line connecting intersections of the curved surface and an inclined surface and the curved surface becomes smaller than a cross-sectional area of that cross section before the conditioning.

3. The method of reconditioning a corrugating roll according to claim 1, wherein the corrugating roll has the crest in a bone flute shape, and the conditioning is performed such that a cross-sectional area of a cross section surrounded by a straight line connecting a starting point and an end point at which the crest contacts the corrugated medium and the curved surface of the crest becomes smaller than a cross-sectional area of that cross section before the conditioning.

4. The method of reconditioning a corrugating roll according to claim 1, further comprising:

conditioning such that polishing of a bottom of a trough of the second corrugating roll to be intermeshed with the first corrugating roll is minimized in order to increase a curvature of a curved surface including the bottom, in accordance with an increase in the curvature of the curved surface of the crest of the first corrugating roll upon the reconditioning, and conditioning such that a difference between a curvature of a curved surface of a crest on the first corrugating roll and a curvature of a curved surface of a trough on the second corrugating roll after the reconditioning, is substantially the same as that before the reconditioning and that a difference between a curvature of a curved surface of a crest on the second corrugating roll and a curvature of a curved surface of a trough on the first corrugating roll after the reconditioning is substantially the same as that before the reconditioning.

* * * * *